United States Patent [19]

Hermle

[11] 4,238,654

[45] Dec. 9, 1980

[54] SWITCHGEAR

[76] Inventor: Eduard Hermle, Kirchstr. 20, 7303 Neuhausen, Fed. Rep. of Germany

[21] Appl. No.: 71,239

[22] Filed: Aug. 30, 1979

[30] Foreign Application Priority Data

Sep. 2, 1978 [DE] Fed. Rep. of Germany ..... 2838373

[51] Int. Cl.[3] ..... H01H 3/42

[52] U.S. Cl. ..... 200/153 LB

[58] Field of Search ..... 200/47, 153 L, 153 LB, 200/38 R

[56] References Cited

U.S. PATENT DOCUMENTS

| | | | |
|---|---|---|---|
| 2,978,553 | 4/1961 | Bundy et al. | 200/153 LB |
| 3,569,992 | 3/1971 | Papa, Jr. | 200/153 LB |
| 3,958,463 | 5/1976 | Block et al. | 200/153 LB |

*Primary Examiner*—Willis Little

*Attorney, Agent, or Firm*—Shenier & O'Connor

[57] ABSTRACT

Switchgear has switches 14 actuated by cam discs 16, 18 mounted on a shaft 12. The angular position of the cams can be adjusted, and they are then held in position by regions of a deformable material 52 which are bent into recesses 38 on a part fixed to the shaft 12. Cam discs 16, 18 are normally mounted in pairs and a friction disc 40 may be mounted between them.

12 Claims, 3 Drawing Figures

SWITCHGEAR

The invention relates to a switchgear with a rotatable control shaft which, for operating switches arranged alongside the control shaft, carries several cam discs which are held on the control shaft rotatably and can be fixed in position thereon.

Switchgear of this type is widely used for the control of presses, in which each stroke must be initiated individually by the operator, so that operational safety assumes a particularly great importance. However this can be provided only if the cam discs of the switchgear, in spite of the particularly strong and frequent accelerations and decelerations, do not move out of position, i.e. do not undergo rotation relative to the control shaft once their position has been set.

In most of the conventional switchgear of the type mentioned at the outset, the securing of the cam discs is of a force-locking or frictional nature only. In a known switchgear, for example the one described in German Gebrauchsmuster 73 21 672, support sleeves having a square aperture are seated on a square region of the control shaft, so that they are secured against rotation on the control shaft by form-locking contact, and on each of the support sleeves two cam discs are slipped which can be rotated on the support sleeve for adjustment purposes. The sleeve has a flange and a contiguous hub with an external thread and a flattened portion. To effect securing against rotation of the cam discs adjusted in accordance with the desired switching contacts, the cam discs are tightened into position by means of a ring nut which can be screwed on the support sleeve hub between the latter and the flange, i.e., in this case only a frictional securing against rotation is provided. In order to ensure that the adjusted cam discs do not rotate during tightening of the ring nut, between the latter and the cam disc adjacent thereto a pressure-transmitting ring is fitted, the aperture of which corresponds to the cross-section of the support sleeve hub in the flattened region, so that the pressure-transmitting ring cannot rotate when the ring nut is tightened. In addition, between the two cam discs, a corrugated spring washer is fitted, which maintains the cam discs in their preset positions even when the ring nuts are loosened, so that they cannot rotate by themselves on the control shaft.

It has now been found in practical experience that in switchgear having cam discs secured against rotation only by such frictional, force-locking means it is impossible to ensure with absolute certainty that the cam discs do not rotate relative to the control shaft during operation under the influence of the resulting accelerations and decelerations, which in turn can lead to accidents if the cam discs concerned operate a switch responsible for safety.

Moreover, another matter deserves to be noted in this connection. Not all switch contacts of such a switchgear control accident-preventive functions; as a rule, however, only these critical switch contacts are adjusted by the vendor of the press, whilst the adjustment of the other switch contacts is effected by the user. For this reasons, the housing of a switchgear cannot be simply set and then permanently leadsealed, since the user must have access to a portion of the switch contacts.

In order to prevent cam discs which have been set from rotating relative to the control shaft during operation, it is already known to provide, after adjustment of the cam discs, a bore passing through the discs and the flange of the associated support sleeve, and to fit into this bore a cotter pin. However, since the cam discs can only be adjusted after the control shaft has been fitted into the switchgear housing, this means not only that the bore has to be driven obliquely from above, i.e. not parallel to the axis of the control shaft, but also that chips may fall within the switchgear housing which, to say the least, cannot be completely removed thereby directly impairing the operational safety of the switchgear itself. It is also quite obvious that this type of securing against rotation is complicated to perform.

According to the invention there is provided switchgear comprising a plurality of switches mounted alongside a control shaft which carries cam discs arranged to actuate the switches as the shaft rotates, each cam disc being adjustable by rotation about the shaft and being adapted to be secured in position, after adjustment, by means which comprises an annular member also carried by the shaft and secured thereto against rotation, and corresponding engagement parts on the cam disc and the annular member, one of the parts being a recess, and the other part being an area of plastically deformable material which can be deformed, once a final position of the cam disc has been reached, into the recess.

In this context, it is self-evident that the cam discs need not be secured against rotation on the control shaft itself by form-locking contact, but that the fundamental concept of the invention can be applied just as well to switchgear in which on the control shaft a support secured by form-locking contact relative thereto is fitted, so that it will suffice to secure the cam discs relative to this support.

The region undergoing plastic deformation must, of course, have adequate mechanical strength to provide adequate securing against rotation, which can be achieved without difficulty by an appropriate dimensioning of this region. Thus, after the adjustment of the cam disc, it will be sufficient, e.g. with the aid of a punch and a hammer, to drive the portion capable of plastic deformation into the slot or recess of the other part in order to achieve the desired form-locking contact. This type of rotation-securing offers the further advantage of being reversible without particular difficulty; nevertheless, the cam disc can still be sealed in a manner of speaking, e.g. by the application of paint to the plastic-deformed region, so that subsequently it can be ascertained at any time whether the securing against rotation has been tampered with.

The requirement of securing the cam disc against rotation by form-locking contact in any desired position can be satisfied in the simplest manner by giving the region capable of plastic deformation an annular shape, so that a section of the deformable region can be bent into the recess in any position of angular rotation of the cam disc concerned. However, the portion capable of plastic deformation need not necessarily be of annular shape, because it may also be constituted, e.g. by the radially external portion of a flat circular disc.

The fundamental concept of the invention can be applied in a particularly simple manner to switchgear of the type described in German Gebrauchsmuster 73 21 672, i.e. to a switchgear in which the cam discs are associated with the switches in pairs and are mounted on support sleeves which can be fitted on the control shaft and are secured against rotation thereon, and which comprises a shoulder or flange adjacent to a cam disc. In such a switchgear, the recess used for rotation-securing of the cam disc adjacent to the shoulder is formed in the shoulder itself, and a ring provided with a slot can be fitted rotation-secured relative to the support sleeve on the latter adjacent to the second cam disc. It will then suffice to form, in the support sleeve flanges already provided in the known switchgear and in the similarly provided, rotation-secured pressure transmitting ring, one or several recesses and to provide on the cam discs regions capable of plastic deformation, in order to achieve the rotation-securing of the cam discs in accordance with the invention.

In the known switchgear according to the German Gebrauchsmuster 73 21 672, the pressure-transmitting ring pressed by the ring nut against the cam discs has a substantially smaller diameter than the corrugated spring washer fitted between the cam discs. Thus, the tension provided by means of the ring nut acts only at the centre of the cam discs, so that a further tightening of the ring nut has little effect. In such a switchgear, in which a disc-shaped pressure-transmitting member is arranged between the cam discs as well as a rotation-secured ring between the ring nut and the cam disc adjacent thereto, the rotation-secured ring may have at least approximately the same diameter as the mutually contacting pressure-transmitting surfaces of the pressure-transmitting member and the cam discs, i.e. the rotation-secured ring will be substantially enlarged with the effect of substantially improved tightening. A contributory effect will result if at least a portion of the pressure transmitting surfaces is constituted by friction linings.

Since in the latter case the corrugated spring washer of the known switchgear is replaced by a disc with friction linings, it is advisable to fit on those sides of the cam discs which face the pressure transmitting member at least one spring oriented against the latter, the fastening of which is effected by a rivet which also holds the region capable of plastic deformation. In this manner, together with the deformable region at least one spring can be made fast with the cam disc.

The invention will now be further described, by way of example, with reference to the accompanying drawings, in which.

Figure 1:
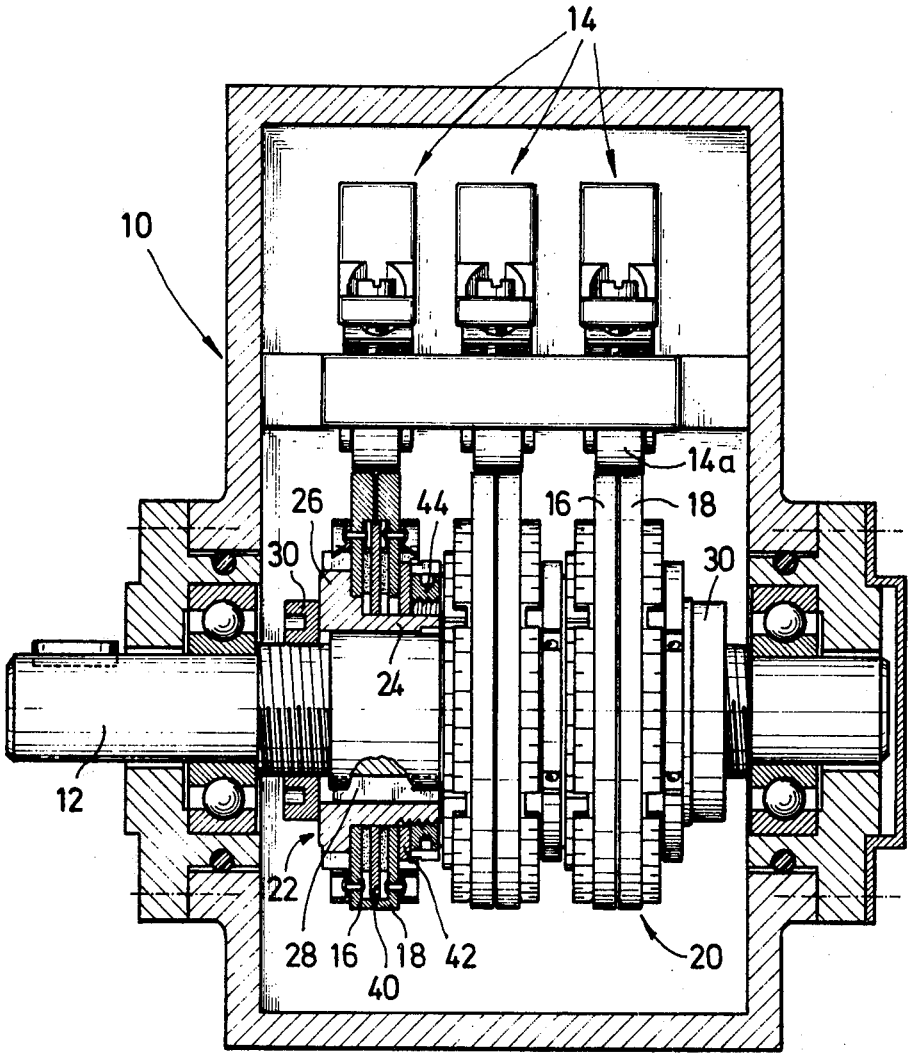
FIG. 1 is a section through a switchgear according to the invention.
Figure 2:
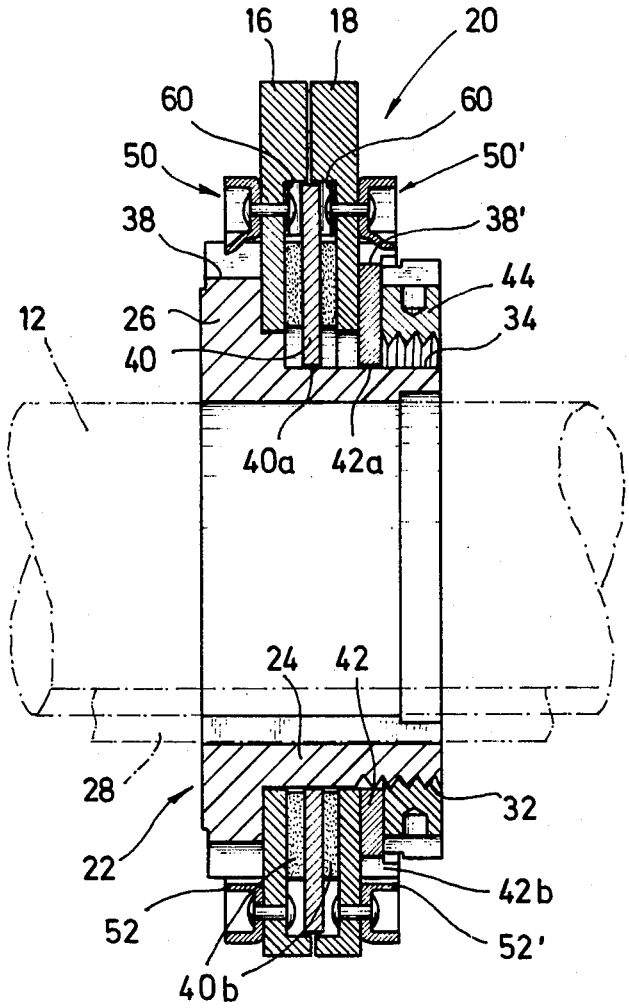
FIG. 2 is a section through a pair of cam discs arranged on a support sleeve.

FIG. 1 shows a housing 10, in which a control shaft 12 is rotatably mounted. Alongside the control shaft and at a distance from the latter the housing accommodates several switches 14, each of which is provided with a roller 14*a* for contacting two cam discs 16 and 18 of a cam disc set 20. As can be clearly seen in FIG. 1, the control shaft 12 carries several such cam disc sets, so that it will suffice to explain in detail the composition of one of these sets with reference to FIGS. 2 and 3.

Each cam disc set 20 has a support sleeve 22 with a hub 24 and a flange 26, and the support sleeves 22 fitted on the control shaft 12 are secured against rotation by means of a locking key 28. Ring nuts 30 (FIG. 1) arranged on both ends of the control shaft 12 prevent an axial displacement of the cam disc sets on the shaft.

Figure 3:
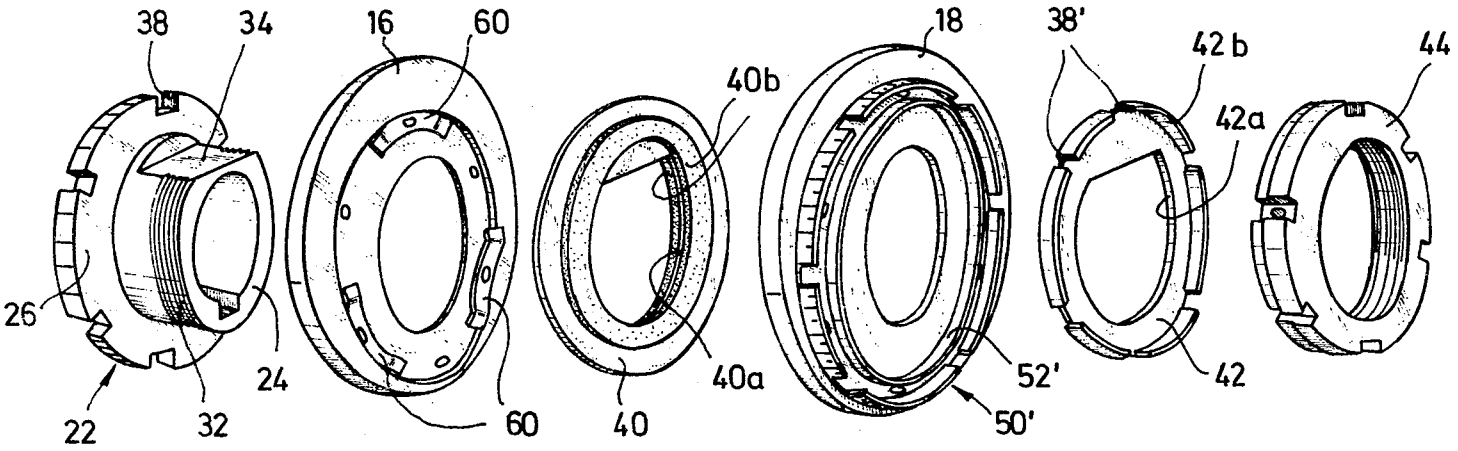
FIG. 3 is a perspective exploded view of the parts to be arranged on a support sleeve.

As FIG. 3 shows, the hub 24 has an external thread 32 cut thereon, and furthermore has on its circumference a flattened portion 34, by means of which the parts slipped thereon can be secured against rotation, as will be described below. The flange 26 of the support sleeve 22 is provided around its circumference with several recesses 38, which serve to secure the cam disc 16 against unintentional rotation on the support sleeve 22.

The cam disc 16 is first fitted on the support sleeve, 22, followed by a pressure-transmitting ring 40, then by the cam disc 18 and finally a safety ring 42, after which a ringnut 44 is screwed on the hub 24 of the support sleeve. The pressure-transmitting ring 40 and the safety ring 42 have apertures 40*a* and 42*a*, the shape of which corresponds to the cross-section of hub 24 of support sleeve 22 in the region of the flattened portion 34, so that the two rings are secured against rotation on the support sleeve.

The safety ring 42 has circumferentially an edge strip 42*b* extending in the axial direction of the control shaft 12 and in which several recesses 38' have been formed. Expediently, the safety ring 42 will be pushed on the support sleeve 22 in such a manner, that the edge strip 42*b* faces away from the adjacent cam disc 18. It is also advisable to select the diameter of the safety ring 42 so the edge strip 42*b* has a diameter the same or preferably greater than that of the ringnut 44.

In the switchgear illustrated, on each cam disc an annular securing member 50 or 50' is riveted, which has an annular portion 52, 52', respectively, extending in the axial direction of the control shaft 12. The material and size of these securing members are such that the annular portions 52, 52' can be plastically deformed and bent into one or more of the recesses 38 or 38' of the flange 26 or of the safety ring 42. In addition, the securing members 50 and 50' have a scale located on the outer circumference, which cooperate with scales on the outer circumference of the flange 26 for the setting of the cam discs 16 and 18.

The pressure transmitting ring 40 is provided on both sides with a friction lining 40*b*, which is pressed against the adjacent cam disc 16 or 18. It is preferable to select the diameter of the safety ring 42 and of the friction linings 40*b* as large as possible, and to correlate these with each other in such a manner, that those regions of the cam discs 16 and 18, on which forces are exerted by the safety ring 42 and the flange 26 during the tightening of the ring nut 44, come to bear as fully as possible on the friction linings 40*b* of the pressure-transmitting ring 40.

The same rivets which serve for the fastening of the securing members 50 and 50' to the cam discs also serve to fasten springs 60 to the sides of the discs which face one another, which springs come to bear on the pressure transmitting ring 40 outside the friction linings 40*b*. Since the pressure transmitting ring 40 cannot rotate on the support sleeve 22, the springs 60, on the other hand, provide, even on loosening of the ring nut 44 a certain frictional contact between each of the cam discs 16 and 18 and the pressure-transmitting ring 40 whilst also ensuring pressure transmission, so that the cam discs cannot rotate immediately and unintentionally on loosening of the ring nut 44.

Following setting of the positions of the cam discs 16 and 18 in the switchgear, the ring nut 44 of each cam disc set 20 is tightened. Owing to the effect of safety ring 42, in not transmitting rotation, the cam disc 18 cannot be displaced during tightening of ring nut 44. Once the ring nut 44 is sufficiently tightened, then parts of annular portions 52 and 52' located outside one or more of the recesses 38 or 38' are pressed by means of a punch or the like into the recesses and during this process permanently deformed, so that the cam disc 16 cannot be rotated any more relative to the flange 26, whilst the cam disc 18 cannot be rotated any more relative to the safety ring 42.

Optionally, it could also be advantageous to fit friction linings to the cam discs as well, in which case the friction linings on the pressure-transmitting ring could optionally be dispensed with.

I claim:

1. Switchgear comprising a rotatable control shaft, a plurality of cam discs carried by said control shaft and being adjustable by rotation about the control shaft, a plurality of switches mounted alongside the control shaft for being actuated by the cam discs as the control shaft rotates, and securing means comprising a securing member disposed on said control shaft adjacent each cam disc and secured against rotation relative to the control shaft, each cam disc and its associated securing member being provided with corresponding engagement parts, one of the engagement parts being a recess, and the other engagement part being an area of plastically deformable material which can be deformed into the recess once a final position of the cam disc has been reached.

2. Switchgear as claimed in claim 1, wherein the area of plastically deformable material is annular.

3. Switchgear as claimed in claim 2, wherein the area of plastically deformable material is an annular, axially extending web.

4. Switchgear as claimed in claim 1, wherein the at least one recess is provided in an annular member, preferably an axially extending web.

5. Switchgear as claimed in claim 1, wherein the area of plastically deformable material is on the cam disc.

6. Switchgear as claimed in claim 1, wherein the recess and the area of plastically deformable material are arranged so that the deformable material can be bent into the recess with the aid of a tool applied from the radially outer side of said area.

7. Switchgear as claimed in claim 1, wherein a securing member is associated with each cam disc, each securing member being rigidly secured to the shaft against rotation as a result of interengaging profiles.

8. Switchgear as claimed in claim 1, wherein the annular member is pressed against the cam disc.

9. Switchgear as claimed in claim 1, wherein a pair of cam discs is associated with each switch, each pair of discs being mounted on a support sleeve having a radially extending flange at one end, the sleeve being mounted on the shaft and secured thereto against rotation, the flange having a recess into which an area of plastically deformable material on an adjacent one of the cam discs can be deformed, a ring being mounted on the sleeve adjacent to the other cam disc, the ring and the sleeve having interengaging internal and external profiles so that the ring is fixed to the sleeve against rotation, the ring having a recess into which an area of plastically deformable material on the other cam disc can be deformed.

10. Switchgear as claimed in claim 9, wherein a pressure transmitting member is arranged between the cam discs of each pair, and a nut screwed onto the sleeve presses the discs against the pressure transmitting member, an annular member being mounted between the nut and the nearest one of the cam discs, said annular member having substantially the same diameter as the mutually-contacting pressure-transmitting surfaces of the pressure-transmitting member and of the cam discs.

11. Switchgear as claimed in claim 10, wherein at least parts of the pressure-transmitting surfaces carry friction linings.

12. Switchgear as claimed in claim 10, wherein the area of plastically deformable material is on the cam disc and wherein each cam disc carries a spring directed against the pressure-transmitting member, the spring being fastened to the disc by a rivet which also secures the area of plastically deformable material.

* * * * *